United States Patent [19]

Umeha et al.

[11] Patent Number: 4,612,695

[45] Date of Patent: Sep. 23, 1986

[54] METHOD OF MANUFACTURING A HOLLOW CAM SHAFT

[75] Inventors: Genkichi Umeha, Tokyo; Yoshiaki Fujita; Atsushi Shimura, both of Saitama, all of Japan

[73] Assignee: Nippon Piston Ring Co., Ltd., Tokyo, Japan

[21] Appl. No.: 691,937

[22] Filed: Jan. 16, 1985

[30] Foreign Application Priority Data

Jan. 20, 1984 [JP] Japan ..... 59-7033

[51] Int. Cl.[4] ..... B21D 39/00; B23P 11/00

[52] U.S. Cl. ..... 29/505; 29/149.5 R; 72/367; 74/567; 228/182

[58] Field of Search ..... 29/6, 149.5 R, 522 R, 29/523, 505; 228/182; 72/367, 369; 74/567

[56] References Cited

U.S. PATENT DOCUMENTS

| | | | |
|---|---|---|---|
| 2,472,261 | 6/1949 | Mueller | 29/149.5 R UX |
| 2,892,254 | 6/1959 | Garvin | 29/6 X |
| 3,845,667 | 11/1974 | Honrath et al. | 74/767 |
| 3,869,938 | 3/1975 | Schlotterbeck et al. | 74/567 |
| 3,999,277 | 12/1976 | Hamada | 74/567 X |
| 4,293,995 | 10/1981 | Jordan | 29/523 X |

*Primary Examiner*—Charlie T. Moon

*Attorney, Agent, or Firm*—Finnegan, Henderson, Farabow, Garrett & Dunner

[57] ABSTRACT

The method of manufacturing a lightweight, low cost hollow cam shaft includes the steps of forming an integral journal portion in a hollow pipe member by inwardly deforming a portion of the pipe member, such as by coining or spinning, the outer surface of the deformed portion being the bearing surface. Annular grooves formed immediately adjacent the inwardly deformed portion allow residue from an optional finish-grinding operation to escape. Cam members having fitting holes are fixedly mounted on undeformed pipe portions, or on outwardly deformed pipe portions.

14 Claims, 10 Drawing Figures

METHOD OF MANUFACTURING A HOLLOW CAM SHAFT

BACKGROUND OF THE INVENTION

1. Field of the Invention

The present invention relates to a method of manufacturing a low cost, lightweight hollow cam shaft.

2. Description of the Relevant Art

Recently, there has been a concerted effort to decrease the weight of internal combustion engines in order to improve the specific fuel consumption on one hand, and to increase maximum speed and maximum power on the other hand. Consequently, cam shafts of decreased weight and improved wear-resistivity have been sought. In previous attempts to satisfy these requirements, various hollow cam shafts have been developed which are lighter than solid crank shafts and have high wear-resistivity, such as cam shafts using separate journal pieces and cam members made from sintered materials and mounted on a hollow steel pipe member.

One of the lightweight conventional cam shafts is shown in FIG. 1, wherein on hollow steel pipe member 1, there are mounted several journal pieces 2 and cam members 3 (one of each being shown in cross section). Typically, the outer diameter of each of the cam members 3 is larger than the outer diameter of each of the journal pieces 2. Also, in this type of cam shaft, the difference in outer diameters between pipe member 3 and journal piece 2 is small. Because the resulting thickness of each journal piece 2 is very small, it is very difficult to form the journal piece by a sintering process and to mount it onto the pipe member. Journal pieces formed by a sintering process are likely to be broken.

If the thickness of the journal pieces is made larger so as to overcome these drawbacks, the outer diameter of the pipe member is required to be made smaller, decreasing the mechanical strength, thereof. Thus, prior to the present invention, in order to decrease the outer diameter of the pipe without decreasing the mechanical strength a smaller inner pipe diameter was required which unavoidably increased the thickness of the pipe member. Any increase in the thickness of the pipe member causes a corresponding increase in both the weight and cost of the cam shaft.

SUMMARY OF THE INVENTION

In accordance with the invention, as embodied and broadly described herein, the method of manufacturing a hollow cam shaft of this invention comprises first selecting a hollow metal pipe member having an outside diameter and a longitudinal axis, and then forming a journal portion in the pipe member at at least one location along the pipe axis. The journal portion forming step includes the substep of inwardly deforming a portion of the pipe member at the one location, the inwardly deformed pipe member portion having a bearing surface with an outside diameter less than the undeformed pipe outside diameter. The method further includes the step of providing camming means at an axial location on the pipe member different from the one location.

Preferably, the journal portion forming step includes the substep of finish-grinding the bearing surface of the decreased diameter pipe portion, and also includes the preliminary substep of forming annular grooves in the pipe member immediately adjacent each axial end of the inwardly deformed pipe portion. In this preferred method, the outside diameter of the grooves are less than the outside diameter of the inwardly deformed pipe portion, whereby residue formed during the finish-grinding step can escape without scarring the bearing surface.

It is also preferred that the providing camming means step include the step of mounting at least one cam member on the pipe member at a location different from the one location, the cam member being of the type having a fitting hole. The mounting step includes the substeps of selecting a cam member having a fitting hole sized for the outside diameter of the pipe member at said different location, fitting the cam member on the pipe member at the different location, and fixedly connecting the cam member to the pipe member at the different location.

It is further preferred that the step of providing camming means includes the preliminary step of forming a mounting surface at the different location for mounting the cam member. The mounting surface forming step includes the substep of outwardly deforming the portion of the pipe member at the different location. In this further preferred method, the outside diameter of the outwardly deformed pipe portion is made greater than the undeformed pipe outside diameter.

The accompanying drawings which are incorporated in, and constitute a part of this specification, illustrate two embodiments of the invention and, together with the description, serve to explain the principles of the invention.

DESCRIPTION OF THE PREFERRED EMBODIMENTS

Figure 1:
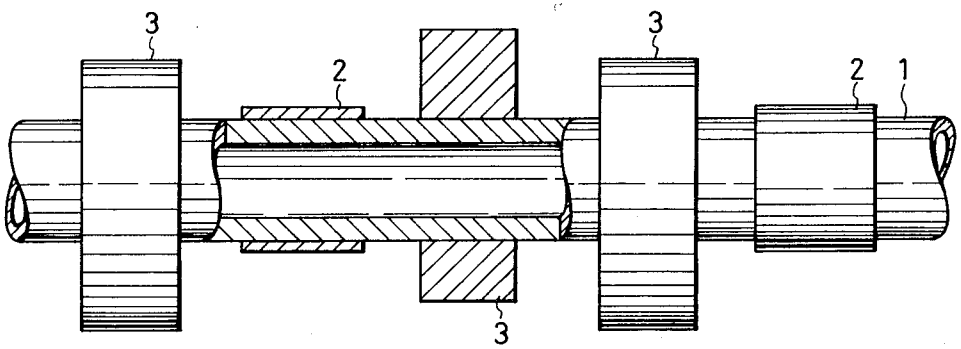
FIG. 1 PRIOR ART
FIG. 1 is a cross section in part of a conventional hollow cam shaft.

Typical embodiments of the present invention will be explained referring to the drawings.

Figure 2:
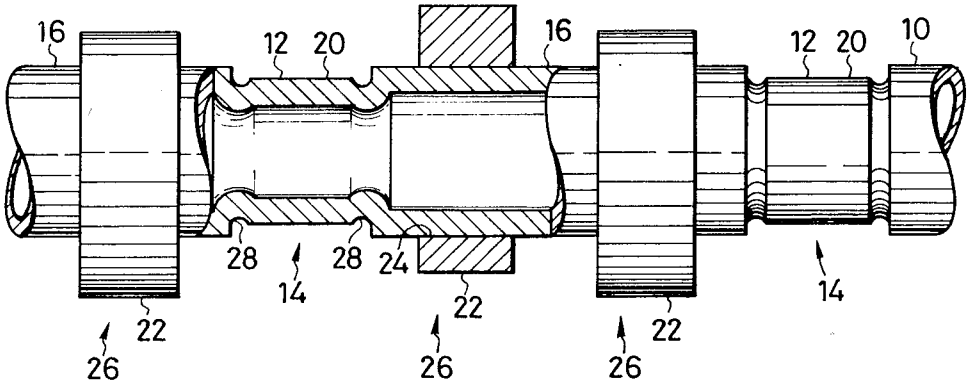
FIG. 2 is a cross section in part of a hollow cam shaft made according to one embodiment of the method of the present invention.

A hollow cam shaft manufactured by a method according to the present invention is shown in FIG. 2 and includes a pipe member 10 made of steel or other suitable material. Pipe member 10 has journal portions 12 each formed at a pre-selected location 14 by inwardly deforming a portion of pipe member 10 so as to have a diameter smaller than the diameter of other portions of pipe member 10, such as undeformed, large diameter portions 16. Pipe member 10 also has one or more cam members 22 fitted onto, and fixedly connected to, pipe member 10 at the large diameter portions 16, as will be discussed hereinafter.

It is an indispensable feature of the present invention to form small diameter portions by inwardly deforming the pipe member and to use the small diameter portions as integral journal portions. Outer bearing surfaces 20 of the journal portions 12 may be subjected to a surface hardening process, such as carburizing or quenching operation, if necessary, after the inwardly deforming step. Thereafter, a finish-grinding operation can be performed.

The above-described deformation of the pipe member 10 for forming the small diameter portions may be performed by a coining operation wherein a tool simultaneously squeezes the entire circumferential area of portion 12 of the pipe 10. Alternately, inwardly deformed portions 12 can be formed using a spinning process wherein a tool is pressed to a portion 12 of the pipe member 10 while simultaneously rotating the pipe member 10. Other processes may selectively be used to form the small diameter portion instead of the above-described forming processes.

The FIG. 2 embodiment of the method of the present invention further includes selecting cam members such as cam member 22, each having a fitting hole 24 whose diameter is substantially the same as the outer diameter of undeformed, large diameter portions 16 of the pipe member 10. Each cam member 22 is fitted to a large diameter portion 16 of the pipe member 10 at predetermined axial portion 26, and then each cam member 22 is fixedly connected to the pipe member 10 to thereby constitute the cam portions. The cam members 22 may be connected to pipe member 10 by sintering, caulking, or soldering operations.

Figure 3:
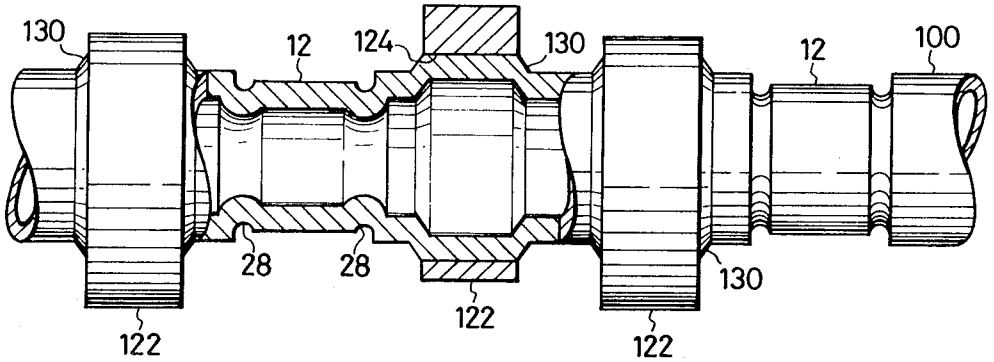
FIG. 3 is a cross section in part of a hollow cam shaft made according to another embodiment of the method of the present invention.

Another embodiment of the present method invention will be explained referring to FIG. 3. In FIG. 3, like reference numerals designate like components in respect to the embodiment in FIG. 2.

In FIG. 3, portions 12 of pipe member 100 are deformed inwardly at preselected locations 14, as in the previously discussed embodiment. However, in the method used to manufacture the cam shaft shown in FIG. 3, large diameter portions 130 are formed at the locations 26 of the pipe member 100 where cam members 122 are to be affixed. Larger diameter portions 130 can be formed by outwardly expanding pipe member 100 at the desired locations 26 such as by a bulging process or similar expanding technique. Then, larger diameter portions 130 are fitted into fitting holes 124 of cam members 122, which fitting hole diameters are substantially the same as the outer diameter of the larger diameter portion 130. Each of the cam members 122 are thereafter fixedly connected to pipe member 100 to thereby constitute a cam portion of the cam shaft using one of the above-described joining techniques.

In the FIG. 3 embodiment, the outer diameter of the larger diameter portions 130 can be made greater than the outer diameter of undeformed, large diameter portion 16 of FIG. 2 by use of an expansion step. Consequently, the volume of cam member 122 of FIG. 3 can be decreased relative to the volume of cam member 22 of FIG. 2 by an amount equal to $$\pi t(De^2 - Do^2)/4$$

where

De is the outside diameter of the outwardly deformed pipe portion,

Do is the outside diameter of the undeformed pipe portion, and t is the axial thickness of the cam member.

Thus, the hollow cam shaft shown in FIG. 3 can be decreased in weight and cost compared to the cam shaft depicted in FIG. 2.

Alternate procedures for forming the small diameter portions 12 of e.g. pipe member 10 using a spinning process will now be explained by reference to FIGS. 4A–4B and 5A–5E.

Figure 4B:
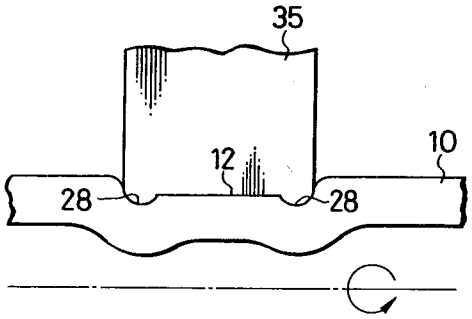
FIGS. 4A–4B and 5A–5E are explanatory drawings showing steps in the methods of manufacturing a journal portion of the cam shafts shown in FIGS. 2 and 3, respectively.
Figure 4A:
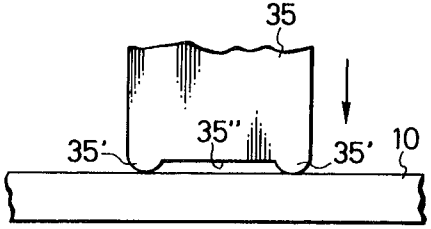

Forming tool 35 shown in FIGS. 4A and 4B has projections 35' at both end surfaces thereof and a planer portion 35'' between the projections 35'. First, tool 35 is pressed against pipe member 10 so as to apply a pressure stress thereto as shown in FIG. 4A. Pipe member 10 is then rotated while applying the pressure stress to the pipe 10 through the tool 35, and annular grooves 28 are formed at portions on the outer periphery of the pipe 10 corresponding to the locations projections 35' of the tool. Simultaneously, an annular, small diameter portion 12 is formed at the outer periphery of pipe member 10 between the annular grooves 28.

Figure 5A:
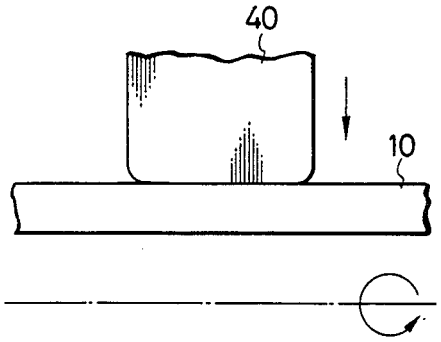
Figure 5B:
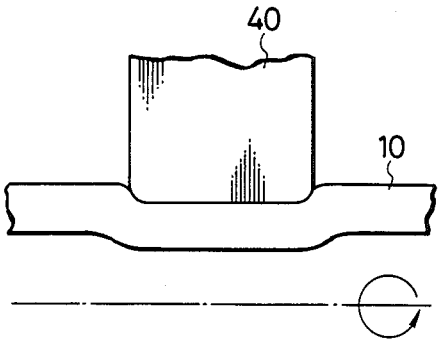
Figure 5C:
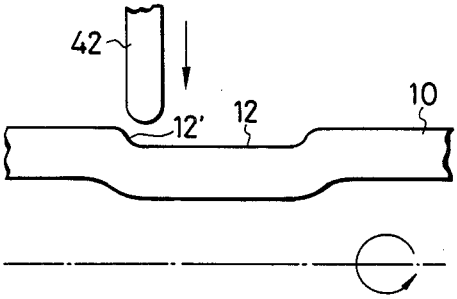
Figure 5D:
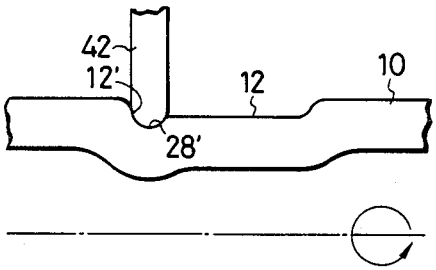
Figure 5E:
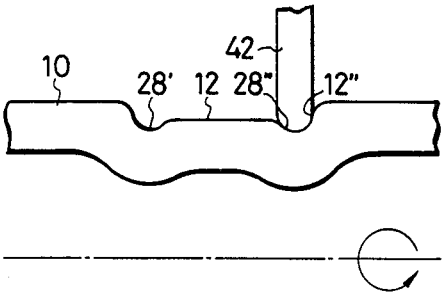

FIGS. 5A–5E show an alternate method of forming the small diameter portions 12 on pipe member 10 by utilizing flat forming tool 40 and a separate rod tool 42. Flat tool 40 is pressed to the pipe member 10 so as to apply a pressure stress thereto as shown in FIG. 5A. In this state, pipe member 10 is rotated with the pressure stress continuing to be applied through tool 40. Small diameter portion 12 is thus formed on the outer periphery of the pipe member 10 as shown in FIG. 5B. Next, rod tool 42 is pressed at an end portion 12' of the small diameter portion 12 so as to apply a pressure stress thereto as shown in FIG. 5C. In this state, pipe member 10 is rotated while the pressure stress is applied through tool 42 and annular groove 28' is formed at end portion 12' of small diameter portion 12, as shown in FIG. 5D. Tool 42 is next pressed to the other end 12'' of small diameter portion 12 and pipe member 10 rotated while the pressure stress is being applied through tool 42, whereby annular groove 28'' is formed as shown in FIG. 5E.

Next, after forming the small diameter portion at a portion of the pipe member 10, it may be necessary to perform a finishgrinding operation on the surface of the small diameter portion 12 in order to improve the accuracy or size thereof, or to smooth bearing surface 20. A preliminary hardening step, such as quench-hardening, can be used. During the finish-grinding operation, annular grooves 28', 28'' formed at the end portions of small diameter portion 12 act as escape grooves for passing shavings and other residue from the grinding operation, to prevent the parts of bearing surface 20 adjacent the end portions of the small diameter portion 12 from being scarred.

Thus, according to one embodiment of the present invention, portions of a pipe member are deformed so as to form small diameter portions whose diameters are smaller than a diameter of other portions of the pipe member and the small diameter portions are directly utilized as integral journal portions, thereby eliminating the necessity of providing separate journal pieces. Further, since cam member are fitted onto, and connected to, the undeformed, large diameter portion, the volume of the each cam member can be decreased compared with a case as shown in FIG. 1 where a small diameter hollow pipe member is used to support separate journal pieces and cam members. Thus, the hollow cam shaft of this embodiment of the present method invention can result in decreased weight and cost compared to conventional hollow cam shafts.

Further, according to another embodiment of the present method invention, and in addition to forming the small diameter portions by inwardly deforming selected pipe portions, other portions of the steel pipe are outwardly deformed to form larger diameter portions whose outer diameters are larger than the diameters of remaining portions of the pipe member including the undeformed portions. The cam members are fitted onto, and connected to, the larger diameter portions. Consequently, the volume of each cam member can be further decreased compared with a case where each cam member is connected to an undeformed portion of the pipe, as explained previously. Thus, the hollow cam shaft of this latter embodiment can result in a further decrease in weight and cost compared to hollow cam shafts which are not outwardly expanded.

It will be apparent to those skilled in the art that various modifications and variations can be made in the cam shaft manufacturing method of the present invention. Thus, it is intended that the present invention cover the modifications provided they come within the scope of the appended claims and their equivalents.

What is claimed is:

1. A method of manufacturing a hollow cam shaft comprising the steps of:

a. selecting a hollow metal pipe member having an outside diameter and a longitudinal axis;

b. forming a journal portion in the pipe member at at least one location along the pipe axis, said journal portion forming step including the substep of inwardly deforming a portion of the pipe member at said one location, the inwardly deformed pipe member portion having a bearing surface with an outside diameter less than the undeformed pipe outside diameter; and c. mounting at least one cam member on the pipe member at a location different from said one location, said cam member of the type having a fitting hole, said mounting step including the substeps of (1) selecting a cam member having a fitting hole sized for the outside diameter of the pipe member at said different location, (2) fitting the cam member on the pipe member at said different location, and (3) fixedly connecting the cam to the pipe member at said different location.

2. The method as in claim 1 wherein the bearing surface forming step includes the substep of finish-grinding the bearing surface of the decreased diameter pipe portion, and also includes the preliminary substep of forming annular grooves in the pipe member immediately adjacent each axial end of the inwardly deformed pipe portion, the outside diameter of the grooves being less than the outside diameter of the inwardly deformed pipe portion, whereby residue formed during said finish-grinding step can escape without scarring the bearing surface.

3. The method as in claim 2 wherein said groove forming substep is carried out concurrently with said inwardly deforming step.

4. The method as in claim 1 wherein said inwardly deforming substep is carried out using a coining process.

5. The method as in claim 1 wherein said inwardly deforming substep is carried out using a spinning process.

6. The method as in claim 2 wherein said bearing surface forming step includes the additional substep of quench-hardening the inwardly deformed surface after groove forming and prior to finish-grinding.

7. The method as in claim 1 wherein said connecting substep is carried out using a sintering process.

8. The method as in claim 1 wherein said connecting substep is carried out using a caulking process.

9. The method as in claim 1 wherein said connecting substep is carried out using a soldering process.

10. The method as in claim 1 wherein the selecting step includes selecting a cam member having a fitting hole sized for the undeformed pipe member outside diameter, and wherein the pipe member of said different location is undeformed.

11. A method of manufacturing a hollow cam shaft comprising the steps of:

a. selecting a hollow metal pipe member having an outside diameter and a longitudinal axis;

b. forming a journal portion in said pipe member at at least one location along the pipe axis, said journal portion forming step including the substep of inwardly deforming a portion of the pipe member at said selected location, the inwardly deformed pipe member portion having a bearing surface with an outside diameter less than the undeformed pipe outside diameter;

c. forming a mounting surface at at least one location different from said selected location for mounting a cam member, said mounting surface forming step including the substep of outwardly deforming the portion of the pipe member at said different location the outside diameter of said outwardly deformed pipe portion being made greater than the undeformed pipe outside diameter; and d. mounting a cam member of the type having a fitting hole on the pipe member, said mounting step including the substeps of (1) selecting a cam member having a fitting hole sized for the outside diameter of the outwardly deformed pipe portion, (2) fitting the cam member on the outwardly deformed pipe portion, and (3) fixedly connecting the cam member to the outwardly deformed pipe portion.

12. The method as in claim 11 wherein the outwardly expanding step is carried out using a bulging process.

13. A method of manufacturing a hollow cam shaft comprising the steps of:

a. selecting a hollow metal pipe member having an outside diameter and a longitudinal axis;

b. forming a journal portion in the pipe member at at least one location along the pipe axis, said journal portion forming step including the substeps of (1) inwardly deforming a portion of the pipe member at said one location, the inwardly deformed pipe member portion having a bearing surface with an outside diameter less than the undeformed pipe outside diameter, (2) forming annular grooves in the pipe member immediately adjacent each axial end of the inwardly deformed pipe portion, the outside diameter of the grooves being less than the outside diameter of the inwardly deformed pipe portion, and (3) finish-grinding the bearing surface of the decreased diameter pipe portion, the residue formed during said finish-grinding step escaping through said annular grooves without scarring the bearing surface; and c. mounting at least one cam member on the pipe member at a location different from said one location, said cam member of the type having a fitting hole, said mounting step including the substeps of (1) selecting a cam member having a fitting hole sized for the outside diameter of the pipe member at said different location, (2) fitting the cam member on the pipe member at said different location, and (3) fixedly connecting the cam member to the pipe member at said different location.

14. A method of manufacturing a hollow cam shaft comprising the steps of:

a. selecting a hollow metal pipe member having an outside diameter and a longitudinal axis;

b. forming a journal portion in the pipe member at at least one location along the pipe axis, said journal portion forming step including the substeps of (1) inwardly deforming a portion of the pipe member at said one location, the inwardly deformed pipe member portion having a bearing surface with an outside diameter less than the undeformed pipe outside diameter, (2) forming annular grooves in the pipe member immediately adjacent each axial end of the inwardly deformed pipe portion, the outside diameter of the grooves being less than the outside diameter of the inwardly deformed pipe portion, and (3) finish-grinding the bearing surface of the decreased diameter pipe portion, the residue formed during said finish-grinding step escaping through said annular grooves without scarring the bearing surface;

c. forming a mounting surface at at least one location different from said selected location for mounting a cam member, said mounting surface forming step including the substep of outwardly deforming the portion of the pipe member at said different location, the outside diameter of said outwardly deformed pipe portion being made greater than the undeformed pipe outside diameter; and d. mounting a cam member of the type having a fitting hole on the pipe member, said mounting step including the substeps of (1) selecting a cam member having a fitting hole sized for the outside diameter of the outwardly deformed pipe portion, (2) fitting the cam member on the outwardly deformed pipe portion, and (3) fixedly connecting the cam member to the outwardly deformed pipe portion.

* * * * *